US009988134B1

(12) United States Patent
Gable et al.

(10) Patent No.: US 9,988,134 B1
(45) Date of Patent: Jun. 5, 2018

(54) SYSTEMS AND METHODS FOR CONTROLLING MOVEMENT OF A MARINE VESSEL USING FIRST AND SECOND PROPULSION DEVICES

(71) Applicant: Brunswick Corporation, Lake Forest, IL (US)

(72) Inventors: Kenneth G. Gable, Oshkosh, WI (US); Travis C. Malouf, Oconomowoc, WI (US); Joseph S. Dimig, Little Chute, WI (US); Michael J. Lemancik, Oshkosh, WI (US); Jose B. Figueroa, Jr., Waldo, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

(21) Appl. No.: 15/375,615

(22) Filed: Dec. 12, 2016

(51) Int. Cl.

| | |
|---|---|
| ***B63H 25/46*** | (2006.01) |
| ***B63H 20/12*** | (2006.01) |
| ***B63H 20/00*** | (2006.01) |
| ***B63H 25/02*** | (2006.01) |
| ***B63H 25/42*** | (2006.01) |
| *B63J 99/00* | (2009.01) |

(52) U.S. Cl.
CPC ..... *B63H 20/12* (2013.01); *B63H 20/007* (2013.01); *B63H 25/02* (2013.01); *B63H 25/42* (2013.01); *B63B 2718/00* (2013.01); *B63H 2020/003* (2013.01); *B63H 2025/026* (2013.01); *B63J 2099/006* (2013.01)

(58) Field of Classification Search
CPC ..... B63H 20/12; B63H 20/007; B63H 25/02; B63H 25/42
USPC ..... 114/150, 151
See application file for complete search history.

(56) References Cited

U.S. PATENT DOCUMENTS

| | | | | |
|---|---|---|---|---|
| 5,401,195 | A | 3/1995 | Yocom | |
| 6,230,642 | B1 * | 5/2001 | McKenney | B63H 25/02 114/144 R |
| 6,234,853 | B1 | 5/2001 | Lanyi et al. | |
| 6,273,771 | B1 | 8/2001 | Buckley et al. | |
| 6,325,683 | B1 | 12/2001 | Yocom | |

(Continued)

OTHER PUBLICATIONS

Unpublished U.S. Appl. No. 15/246,681, filed Aug. 25, 2016 entitled "Methods for Controlling Movement of a Marine Vessel Near an Object".

*Primary Examiner* — Stephen P Avila
(74) *Attorney, Agent, or Firm* — Andrus Intellectual Property Law, LLP

(57) ABSTRACT

Systems and methods are for controlling movement of a marine vessel extending along a longitudinal axis between a bow and a stern and along a lateral axis between a port side and a starboard side, having a first propulsion device located closer to the stern than to the bow and steerable about a first steering axis perpendicular to the longitudinal and lateral axes, a second propulsion device located closer to the bow than to the stern and steerable about a second steering axis perpendicular to the longitudinal and lateral axes. An input device is configured to input a request for movement of the marine vessel. A control module is configured to control steering and thrust of the first and second propulsion devices to achieve a resultant movement of the marine vessel commensurate with the request for movement.

15 Claims, 13 Drawing Sheets

(56) References Cited

U.S. PATENT DOCUMENTS

| | | | | |
|---|---|---|---|---|
| 6,394,015 | B1 * | 5/2002 | Gabriel | B63B 43/18 114/151 |
| 6,799,528 | B1 * | 10/2004 | Bekker | B63H 20/00 114/151 |
| 7,121,219 | B1 | 10/2006 | Stallings | |
| 7,267,068 | B2 | 9/2007 | Bradley et al. | |
| 7,305,928 | B2 | 12/2007 | Bradley et al. | |
| 7,467,595 | B1 | 12/2008 | Lanyi et al. | |
| 8,478,464 | B2 | 7/2013 | Arbuckle et al. | |
| 8,777,681 | B1 | 7/2014 | McNalley et al. | |
| 8,807,059 | B1 | 8/2014 | Samples et al. | |
| 9,126,667 | B2 | 9/2015 | Mizutani | |
| 9,132,903 | B1 | 9/2015 | Gable et al. | |
| 9,434,460 | B1 | 9/2016 | Samples et al. | |
| 9,440,724 | B2 | 9/2016 | Suzuki et al. | |
| 2016/0246300 | A1 | 8/2016 | Langford-Wood | |

* cited by examiner

SYSTEMS AND METHODS FOR CONTROLLING MOVEMENT OF A MARINE VESSEL USING FIRST AND SECOND PROPULSION DEVICES

FIELD

The present disclosure relates to systems and methods for controlling movement of a marine vessel in a body of water, and more particularly to controlling movement using a first propulsion device and a second propulsion device.

BACKGROUND

The Background and Summary are provided to introduce a selection of concepts that are further described below in the Detailed Description. The Background and Summary are not intended to identify key or essential features of the claimed subject matter, nor are they intended to be used as an aid in limiting the scope of the claimed subject matter.

The following U.S. Patents and Applications are incorporated herein by reference:

U.S. Pat. No. 6,234,853 discloses a docking system that utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,267,068 discloses a marine vessel that is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively control the marine vessel manually and, when the joystick is released, the vessel will maintain the position in which it was at the instant the operator stopped control it with the joystick.

U.S. patent application Ser. No. 15/246,681, filed on Aug. 25, 2016, discloses a method for controlling movement of a marine vessel near an object, including accepting a signal representing a desired movement of the marine vessel from a joystick. A sensor senses a shortest distance between the object and the marine vessel and a direction of the object with respect to the marine vessel. A controller compares the desired movement of the marine vessel with the shortest distance and the direction. Based on the comparison, the controller selects whether to command the marine propulsion system to generate thrust to achieve the desired movement, or alternatively whether to command the marine propulsion system to generate thrust to achieve a modified movement that ensures the marine vessel maintains at least a predetermined range to the object. The marine propulsion system then generates thrust to achieve the desired movement of the modified movement, as commanded.

SUMMARY

The present disclosure generally relates to systems and methods for controlling movement of a marine vessel that extends along a longitudinal axis between a bow and a stern and along a lateral axis between a port side and a starboard side, wherein the longitudinal axis is perpendicular to the lateral axis. A first propulsion device is located closer to the stern than to the bow and is steerable about a first steering axis that is perpendicular to the longitudinal and lateral axes. A second propulsion device is located closer to the bow than to the stern and is steerable at least 10 degrees about a second steering axis that is perpendicular to the longitudinal and lateral axes. A control module is configured to control steering of and thrust provided by both the first and second propulsion devices. An input device is configured to input a request for movement of the marine vessel to the control module, wherein based upon the request for movement, the control module is configured to control steering of and thrust provided by the first and second propulsion devices to thereby achieve a resultant movement of the marine vessel that is commensurate with the request for movement of the marine vessel.

Also disclosed is system for controlling movement of a marine vessel that extends along a longitudinal axis between a bow and a stern and along a lateral axis between a port side and a starboard side, wherein the longitudinal axis is perpendicular to the lateral axis, and wherein the marine vessel has a center of pressure located between the bow and the stern. A first propulsion device is located closer to the stern than to the bow and at a longitudinal distance (A) from the center of pressure, and is steerable about a first steering axis that is perpendicular to the longitudinal axis and perpendicular to the lateral axis. A second propulsion device is located closer to the bow than to the stern and at a longitudinal distance (B) in an opposite direction from the center of pressure as the longitudinal distance (A), and is steerable about a second steering axis that is perpendicular to the longitudinal axis and perpendicular to the lateral axis. A control module is configured to control steering of and thrust provided by both the first propulsion device and the second propulsion device, wherein a steering angle is defined as the angle that the thrust is provided relative to the longitudinal axis. An input device is configured to input a request for movement of the marine vessel to the control module. Based upon the request for movement, the control module is configured to control steering of and thrust provided by both the first propulsion device and the second propulsion device to thereby achieve a resultant movement of the marine vessel that is commensurate with the request for movement of the marine vessel. The request for movement of the marine vessel is one of movement of the marine vessel: parallel to the longitudinal axis; parallel to the lateral axis, without yaw movement with respect to the longitudinal and lateral axes; in translation at an angle to the longitudinal axis and at an angle to the lateral axis; parallel to the lateral axis, with yaw movement with respect to both the longitudinal and lateral axes; in rotation about the center of pressure; or parallel to the longitudinal axis, with yaw movement with respect to both the longitudinal and lateral axes.

A method for controlling movement of a marine vessel that extends along a longitudinal axis between a bow and a stern and along a lateral axis between a port side and a starboard side, wherein the longitudinal axis is perpendicular to the lateral axis, is also disclosed. The method includes: providing a first propulsion device located closer to the stern than to the bow, wherein the first propulsion device is steerable about a first steering axis that is perpendicular to the longitudinal axis and perpendicular to the lateral axis; providing a second propulsion device located closer to the bow than to the stern, wherein the second propulsion device is steerable at least 10 degrees about a second steering axis that is perpendicular to the longitudinal axis and perpendicular to the lateral axis; inputting, with an input device, a request for movement of the marine vessel to control module; and controlling, with the control module, steering of and thrust provided by both the first propulsion device and the second propulsion device to thereby achieve a resultant movement of the marine vessel that is commensurate with the request for movement of the marine vessel.

Various other features, objects and advantages of the disclosure will be made apparent from the following description taken together with the drawings.

BRIEF DESCRIPTION OF THE DRAWINGS

The drawings illustrate the best mode presently contemplated of carrying out the disclosure. The same numbers are used throughout the Figures to reference like features and like components. In the drawings.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

Figure 1:
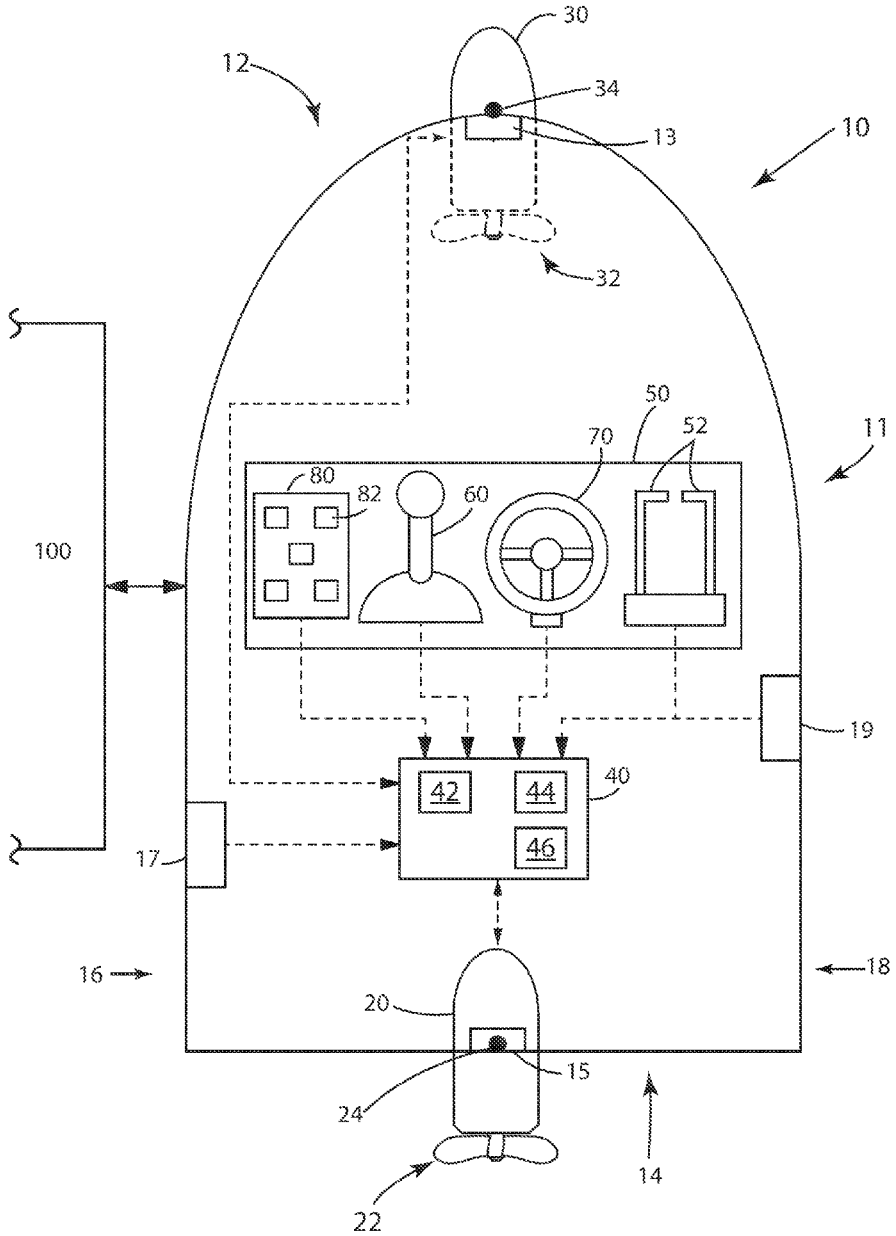
FIG. 1 is a schematic representation of a system for controlling movement of a marine vessel.

FIG. 1 shows a marine vessel 10. The marine vessel 10 is capable of operating, for example, in a normal operating mode, a waypoint tracking mode, an auto heading mode, a station keeping mode, and a joysticking mode, among other modes, as described in U.S. patent application Ser. No. 15/246,681 as incorporated herein. The marine vessel 10 has a first propulsion device 20 and a second propulsion device 30 that produce thrust to propel the marine vessel 10, as will be more fully described herein below. As illustrated, the first propulsion device 20 is an outboard motor and the second propulsion device 30 is a trolling motor. However, each could be any one of an inboard motor, stern drive, pod drive, outboard motor, trolling motor, jet drive, or any other marine propulsion device. Each propulsion device is steerable about its respective first steering axis 24 or second steering axis 34 and produces thrust by causing rotation of its respective first propeller 22 or second propeller 32.

Figure 2:
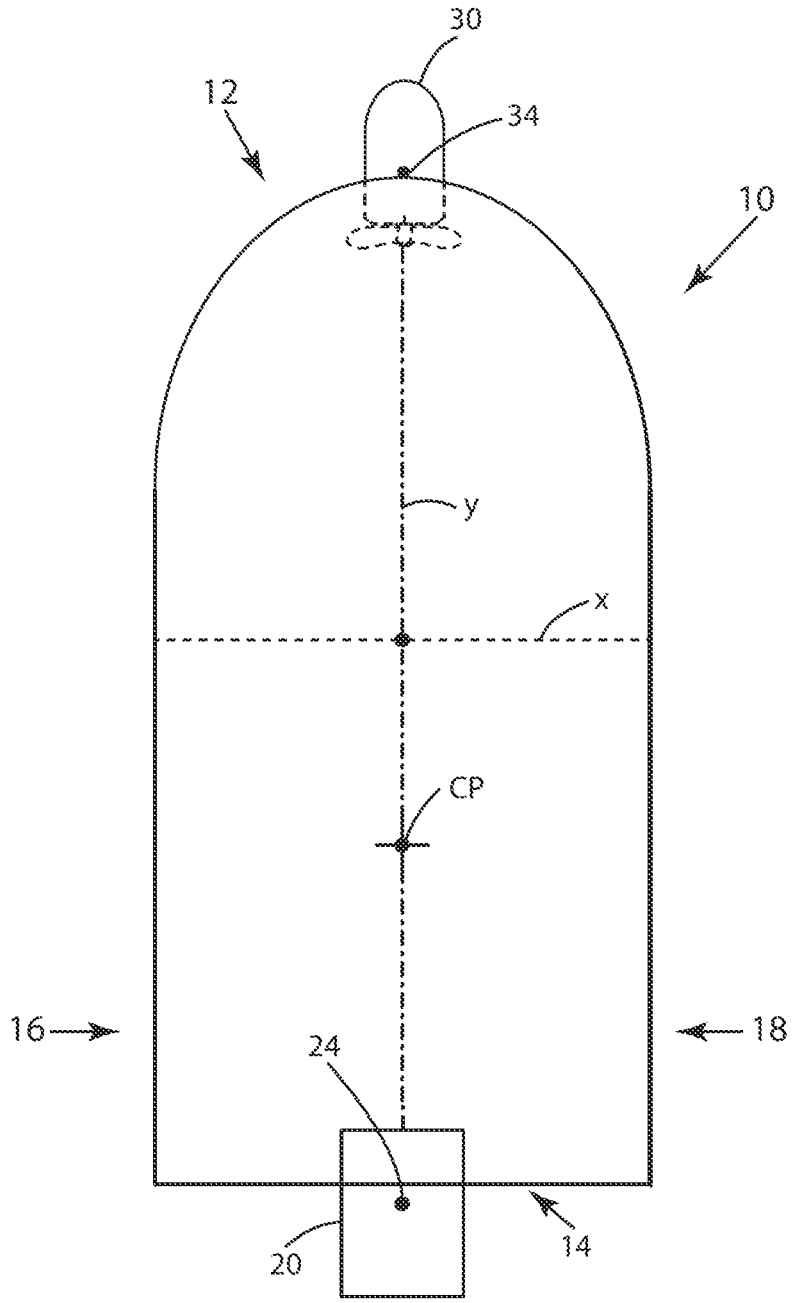
FIG. 2 illustrates the arrangement of axes and a center of pressure for describing the marine vessel.

The marine vessel 10 has a bow 12 opposite a stern 14 and a port side 16 opposite a starboard side 18. As shown in FIG. 2, a longitudinal axis y is defined between the bow 12 and the stern 14, and a lateral axis x is defined between the port side 16 and the starboard side 18 and is perpendicular to the longitudinal axis y. The marine vessel 10 has a center of pressure CP, which is empirically determined as a function of several factors that include the speed of the marine vessel 10 as it moves through the water, the hydrodynamic forces on the hull of the marine vessel 10, the weight distribution of the load contained within the marine vessel 10, and the degree to which the marine vessel 10 is disposed below the waterline. However, a person having ordinary skill in the art will recognize that the position of the center of pressure CP within the marine vessel 10 is also selectable, whereby the marine vessel 10 is then configured to be rotatable about that position using the systems and methods disclosed herein.

Returning to FIG. 1, the first propulsion device 20 and the second propulsion device 30 are rotatable about the first steering axis 24 and the second steering axis 34, respectively, that are generally perpendicular to longitudinal axis y and lateral axis x (i.e., that are generally vertical when the propulsion devices 20, 30 are not tilted or trimmed). The ranges of rotation of the first propulsion device 20 and the second propulsion device 30 may be symmetrical with respect to the longitudinal axis y of the marine vessel 10. With reference to FIGS. 6-12, the steering angle $A_e$ of the first propulsion device 20 and the steering angle $A_t$ of the second propulsion device 30 are each defined as the angle between the direction of the thrust provided and the longitudinal axis y. It is anticipated that the range of steering angle $A_t$ for the second propulsion device 30 is greater than 0° and, thus, adjustable. The control systems and methods of the present disclosure control rotation of the first propulsion device 20 and the second propulsion device 30 about their respective first steering axis 24 and second steering axis 34, adjust their respective operation in a forward gear, a neutral position, or a reverse gear, and adjust the magnitude of their respective thrusts $M_e$ and $M_t$ (shown in FIGS. 6-12). For example, thrust may be adjusted by adjusting engine or motor speed, propeller pitch, and/or transmission slip in an efficient manner that allows rapid and accurate control or maneuvering of the marine vessel 10. The rotation, gear, and thrust magnitude of the first propulsion device 20 can be varied independently of the rotation, gear, and thrust magnitude of the second propulsion device 30, and vice versa.

The marine vessel 10 also includes various control elements that make up a marine propulsion system 11. The marine propulsion system 11 comprises an operation console 50 in communication with a control module 40 that contains a CAN bus 42 as described in U.S. Pat. No. 6,273,771, a processor 44, and a memory 46. As is conventional, the processor 44 can be communicatively connected to a computer readable medium that includes volatile or nonvolatile memory 46 upon which computer readable code is stored. The processor 44 can access and execute the computer readable code within the computer readable medium to carry out functions as described herein below.

In other embodiments, the CAN bus 42 may be external to the control module 40. In further embodiments, the operation console 50 and control module 40 may be connected via wireless communication rather than through physical wiring. It should be noted that the dashed lines shown in FIG. 1 are meant to show only that the various control elements are capable of communication with one another. The dashed lines do not represent actual wiring connecting the control elements, nor do they represent the only paths of communication between the elements.

Figure 13:
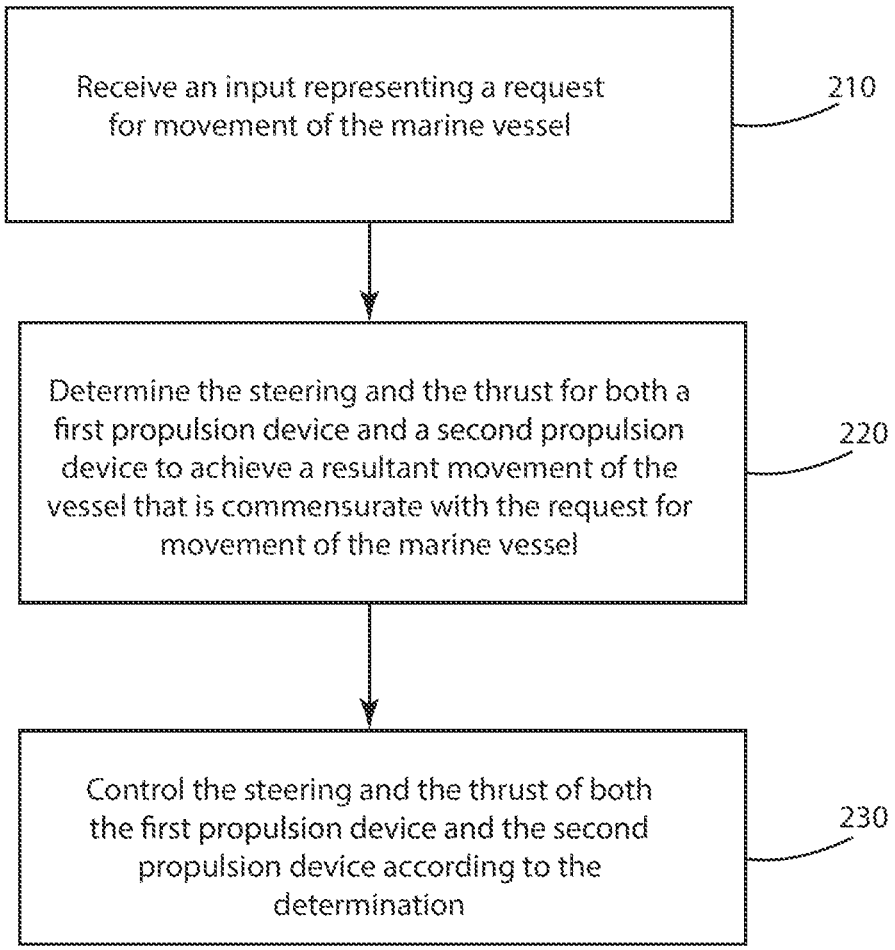
FIGS. 13 and 14 illustrate methods according to the present disclosure for controlling movement of the marine vessel.

The operation console 50 includes a number of input devices, such as a joystick 60, a steering wheel 70, one or more throttle/shift levers 52, and a keypad 80. Each of these input devices may provide a request for movement of the marine vessel 10 to the control module 40. The general process flow for maneuvering a marine vessel 10 according to the present disclosure is shown in FIG. 13. In step 210, the control module 40 receives this input representing the request for movement of the marine vessel 10 from the operating console 50. In step 220, the control module 40, using the processor 44 and memory 46, determines an integrated configuration for controlling the steering and thrust of the first propulsion device 20 and the second propulsion device 30 to achieve a resultant movement of the marine vessel 10 that is commensurate with the request for movement of the marine vessel 10 provided by the operation console 50. This determination may include the use of lookup tables stored in the memory 46, which will be described further below. Following the determination made in step 220, the control module 40 controls the steering and the thrust of each of the first propulsion device 20 and the second propulsion device 30 in accordance with this determination.

In some embodiments, the marine vessel 10 may also include sensors 13, 15, 17, and 19 (shown in FIG. 1) that sense the relative distance between the marine vessel 10 and an external object 100 and the relative direction of the external object 100 from the marine vessel 10. When equipped with these sensors 13, 15, 17, and 19, the systems and methods for controlling movement of the marine vessel 10 may incorporate use of the sensors by replacing the final step 230 shown in FIG. 13 with steps 300-330 shown in FIG. 14, as will be described further herein below.

The steering wheel 70 and the throttle/shift levers 52 function in the conventional manner. For example, rotation of the steering wheel 70 may activate a transducer that provides a signal to the control module 40 regarding a desired movement of the marine vessel 10. The control module 40 in turn sends signals to activate steering actuators to achieve desired orientations of the first propulsion device 20 as known in the art. In accordance with the present systems and methods, the control module 40 also sends signals to activate steering actuators for the second propulsion device 30 in response to rotation of the steering wheel 70 for integrated control of both the first propulsion device 20 and the second propulsion device 30. The first propulsion device 20 and the second propulsion device 30 are independently steerable about the first steering axis 24 and the second steering axis 34, respectively. The throttle/shift levers 52 send signals to the control module 40 regarding the desired gear (forward, reverse, or neutral) and the desired thrust for each of the first propulsion device 20 and the second propulsion device 30. The control module 40 in turn sends signals to activate electromechanical actuators for shift and throttle, respectively.

A manually operable input device, such as the joystick 60, can also be used to input requests for movement to the control module 40. By integrating the control of the first propulsion device 20 and the second propulsion device 30 by way of a single input device (such as a joystick 60) or paired grouping (such as a steering wheel 70 and throttle/shift lever 52 pair), the marine vessel 10 can achieve purely longitudinal movement, purely lateral movement, purely rotational movement, or any combination thereof, as will be described below.

In some embodiments, additional input devices may be incorporated into a paired grouping such that traditional input devices may provide the functions of a joystick 60. For example, while a steering wheel is conventionally only capable of causing a rotational movement of a marine vessel, the present inventors had developed alternative methods and systems for using the steering wheel 70 to request other movements, such as a purely lateral translation movement. In one embodiment, the keypad 80 includes a translation switch 82. When the translation switch 82 is activated and the steering wheel 70 is rotated to either a left stop or a right stop (which are discussed below), the control module 40 identifies that the request for movement is for lateral movement to the port side 16 or the starboard side 18, respectively. In this configuration, the throttle/shift lever 52 is also used to control the magnitude of the thrust generated, thereby controlling the speed at which the marine vessel 10 moves laterally.

It should be recognized that other inputs may be incorporated in addition to, or instead of, those described in the previous embodiments. For example, input may come from other physical devices or from non-human sources, such as from station keeping, waypoint tracking, or heading control systems. Similarly, the control functions described in conjunction with control module 40 may be distributed across multiple control modules, such as separate control modules within the first propulsion device 20 and the second propulsion device 30 (not shown).

Figure 3:
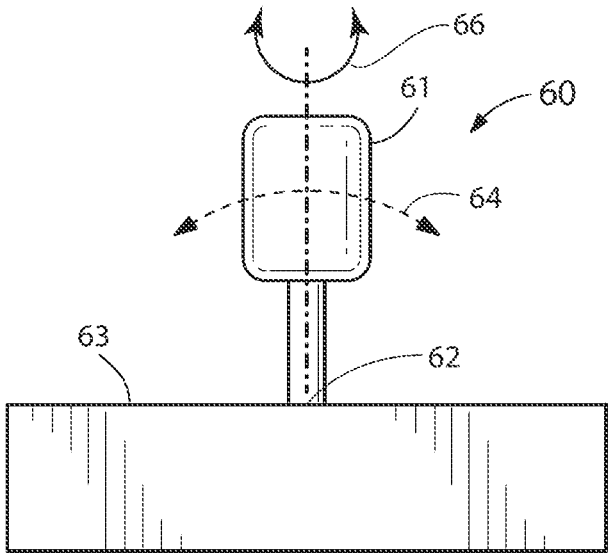
FIG. 3 is a side view of a joystick used to control the marine vessel.

FIG. 3 is a simplified schematic representation of the joystick 60 as a manually operable input device to provide a signal that represents a request for movement of the marine vessel 10. Note that there are many different types of joysticks and other input devices that can be used to provide a signal that is representative of a desired movement of the marine vessel 10. For example, various keypads, track balls, and/or other similar input devices could be used. The embodiment of FIG. 3 shows a joystick 60 having a handle 61 that is operatively coupled at a pivot 62 to a base 63 to allow manipulation of the joystick 60 by hand. In a typical application, the handle 61 provides lateral movement generally represented by arrow 64, longitudinal movement into and out of the plane of the drawing, and rotational movement as generally represented by arrow 66 either in a clockwise CW or a counterclockwise CCW direction. Although arrow 64 is illustrated in the plane of the drawing in FIG. 3, a similar type of movement is possible in other directions that are not parallel to the plane of the drawing.

Figure 4:
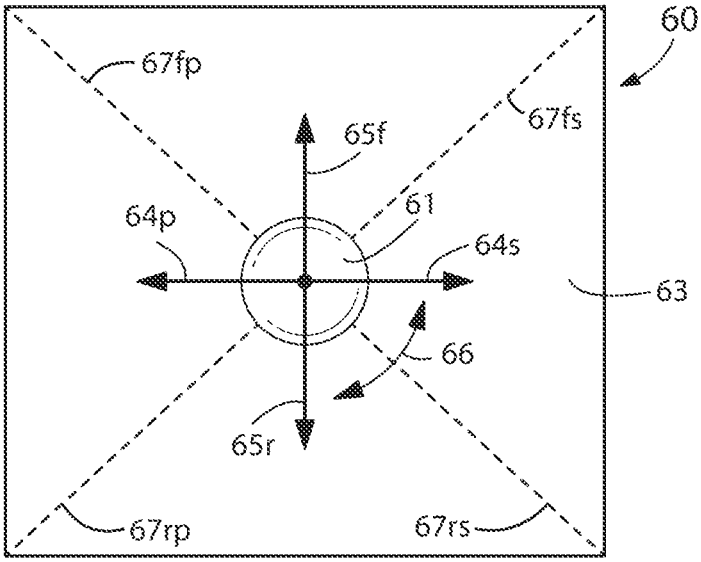
FIG. 4 is a top view of the joystick.

With reference to FIG. 4, which shows a top view of the joystick 60, it can be seen that the operator can request a purely lateral movement either toward the port side 16 as represented by arrow 64*p* or toward the starboard side 18 as represented by arrow 64*s*, a purely longitudinal movement 65 in a forward direction towards the bow 12 as represented by arrow 65*f* or in a reverse direction towards the stern 14 as represented by arrow 65*r*, or combinations of these directions. The handle 61 can also move in various directions in addition to those described above, including those represented by dashed lines 67*fp*, 67*fs*, 67*rp*, and 67*rs*. For example, by moving the handle 61 along dashed line 67*fs*, a lateral movement and a longitudinal movement toward the starboard side and forward can be requested. It should be understood that the operator of the marine vessel can also request a combination of lateral movement, longitudinal movement, or both, also in combination with a rotation as represented by arrow 66. In fact, it should be understood that the handle 61 can move in any direction relative to its axis at pivot 62 and is not limited to the lines of movement represented by the arrows and dashed lines. In fact, the movement of the handle 61 has a virtually infinite number of possible paths as it is tilted about its pivot 62 within the base 63. Any request provided via the joystick 60 is then communicated to the control module 40, which correspondingly controls the first propulsion device 20 and the second propulsion device 30.

The magnitude, or intensity, of movement represented by the position of the handle 61 is also provided as a request via the joystick 60. For example, if the handle 61 is moved slightly toward one side or the other, the requested thrust in that direction is less than if, alternatively, the handle 61 was moved by a greater magnitude away from its vertical position with respect to the base 63. Furthermore, rotation of the handle 61 about the pivot 62, as represented by arrow 66, provides a signal representing the intensity of desired movement. A slight rotation of the handle 61 would represent a request for a slight thrust to rotate the marine vessel 10. On the other hand, a more intense rotation of the handle 61 would represent a command for a higher magnitude of rotational thrust. In this regard, the joystick 60 provides both steering and thrust input.

The joystick 60 can also provide information to the control module 40 regarding its being in an active state or an inactive state. While an operator is manipulating the joystick 60, the joystick 60 is in an active state. However, if the operator releases the joystick 60 and allows its handle 61 to return to a centered/upright and neutral position above the pivot 62, the joystick 60 reverts to an inactive state. In one example, movement of the handle 61 away from the centered state or rotation of the handle 61 about pivot 62, or both, causes the control module 40 to determine that the joystick 60 is in the active state and to subsequently act on the commands from the joystick 60, regardless of the position of the throttle/shift levers 52 or steering wheel 70. In another example, either or both of the throttle/shift levers 52 and steering wheel 70 must be in a detent position before movement of the joystick 60 will result in the control module 40 determining that the joystick 60 is in the active state and subsequently acting on the commands from the joystick 60. In one example, the detent position of the throttle/shift levers 52 is a forward, neutral, or reverse detent position. For example, the first propulsion device 20 and the second propulsion device 30 must both be in neutral before the joysticking mode can be enabled. The detent position of the steering wheel 70 may be a zero-degree position as shown in FIG. 5.

Thus, in a joysticking mode, the user may operate the joystick 60 to command the rotational and/or translational (lateral and/or longitudinal) movements described herein above with respect to FIGS. 3 and 4. In another mode, the throttle/shift levers 52 and the steering wheel 70 can be used to send inputs requesting movement of the marine vessel 10 to the control module 40 to operate the first propulsion device 20 and the second propulsion device 30 in response to such commands, as is conventional to those having ordinary skill in the art.

Figure 5:
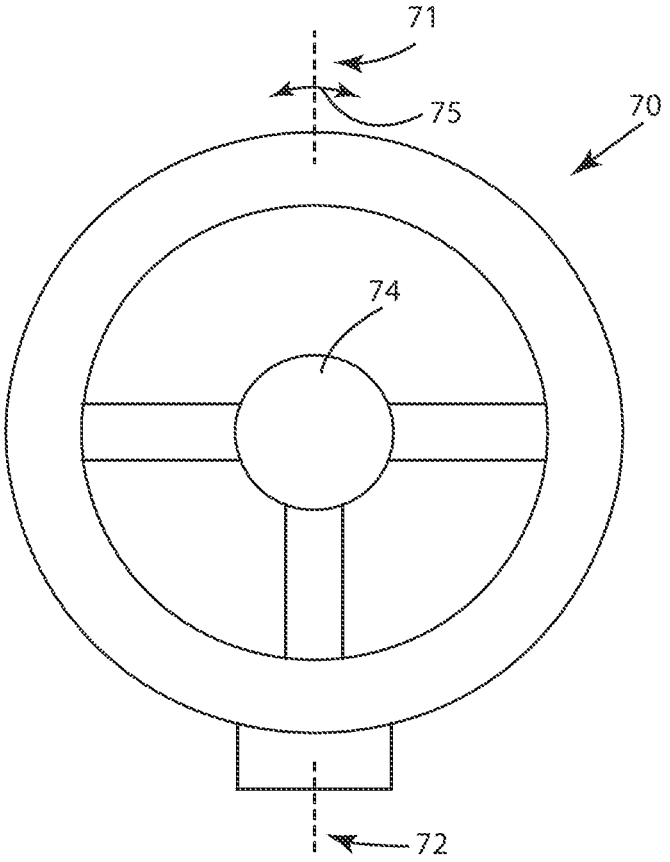
FIG. 5 is a top view of a steering wheel used to control the marine vessel.

FIG. 5 shows an exemplary embodiment of a steering wheel 70 incorporated in an operation console 50 as known in the art. The steering wheel 70 can be rotated about the hub 74 as generally shown by the arrow 75. In one embodiment, a center line 71 is depicted as a dashed line and corresponds to a request for movement of the marine vessel 10 that does not include rotation or yaw. For example, FIG. 1 shows a control configuration in which both the first propulsion device 20 and the second propulsion device 30 output or produce thrust only in directions parallel to the longitudinal axis y. Rotation of the steering wheel 70 may occur in a clockwise or counterclockwise manner, as conventionally known. In the embodiment shown, a stop line 72 is provided such that when the steering wheel 70 is rotated counterclockwise until the center line 71 meets the stop line 72, a left stop condition is met and the steering wheel 70 will no longer rotate in the counterclockwise direction. Similarly, rotation of the steering wheel 70 in a clockwise direction until the center line 71 meets the stop line 72 corresponds to a right stop in which the steering wheel 70 may no longer be rotated in a clockwise direction. It should be noted that in other embodiments the stop line 72 does not provide a physical barrier against further rotation of the steering wheel 70 when met with the center line 71, but instead designates the left stop and right stop corresponding with the maximum steering angle $A_e$, $A_r$ to which the control module 40 will control the first propulsion device 20 and the second propulsion device 30, respectively.

Returning to FIG. 1, the marine vessel 10 can also be provided with one or more sensors 13, 15, 17, and 19. Although one sensor is shown near each of the bow 12, stern 14, and port side 16 and starboard side 18 of the marine vessel 10, fewer or additional sensors could be provided at each location. The sensors 13, 15, 17, and 19 are distance and directional sensors. For example, the sensors could be radars, sonars, cameras, lasers, Doppler direction finders, or other devices individually capable of determining both the direction and distance of an external object 100 near the marine vessel 10, such as a dock, seawall, slip, large rock or tree, etc. Alternatively, separate sensors could be provided for sensing direction than are provided for sensing distance, or more than one type of distance/direction sensor can be provided at a single location on the marine vessel 10.

Figure 14:
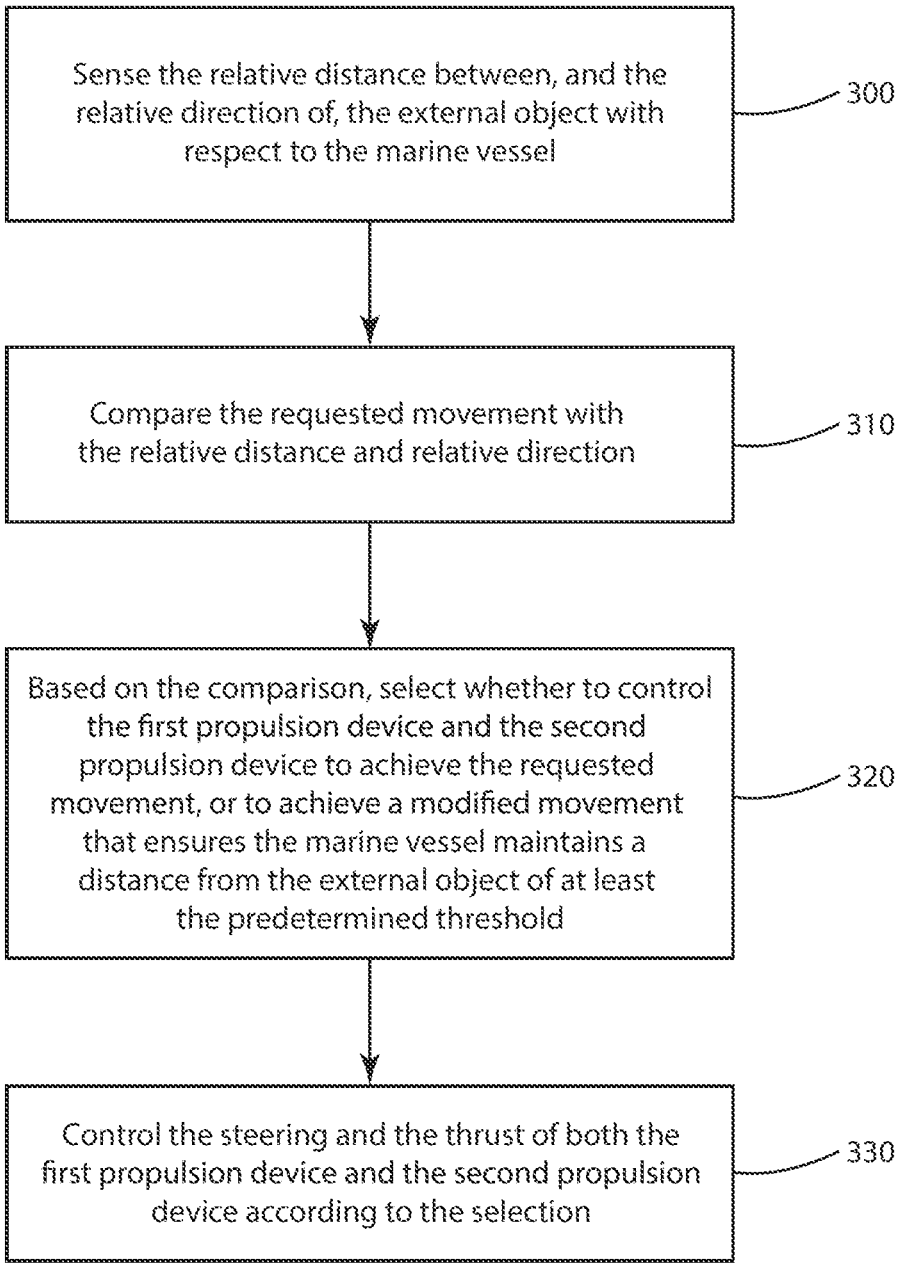

As shown in step 300 of the flow chart of FIG. 14, the sensors 13, 15, 17, and 19 sense and provide information regarding both a relative direction of the external object 100 with respect to the marine vessel 10 and a relative distance between the external object 100 and the marine vessel 10. The sensors 13, 15, 17, and 19 provide this distance and direction information to the control module 40, such as by way of the CAN bus or wireless connections, as described above. As provided in U.S. patent application Ser. No. 15/246,681 and shown in step 310, the control module 40 may compare, using the processor 44 and memory 46, the relative distance and the relative direction from step 300 with any incoming request for movement from an input device in the operation console 50. In step 320, the control module 40 uses the comparison to select whether to subsequently control the first propulsion device 20 and the second propulsion device 30 to achieve the requested movement, or to control the first propulsion device 20 and the second propulsion device 30 to achieve a modified movement that ensures a distance from the external object 100 of at least a predetermined threshold of separation between the marine vessel 10 and the external object 100. This predetermined threshold may be calibrated and stored in a memory 46 of the control module 40 for use by the present maneuvering algorithm. In other examples, the predetermined threshold may depend on the speed of the marine vessel 10 or the mode in which the marine propulsion system 11 is operating, and may be determined from a lookup table or similar input/output map. In still other examples, the operator may input a desired predetermined threshold via the keypad 80 or other interactive display located at the operation console 50.

In one embodiment, the modified movement may include controlling one or both of the first propulsion device 20 and the second propulsion device 30 to achieve one of a lateral movement, a longitudinal movement, or a rotational movement of the marine vessel 10, while cancelling or ignoring one or more of the other components of the movement requested that would cause the marine vessel 10 to move closer to the external object 100 than the permitted predetermined threshold distance. For example, if the request for movement includes both lateral movement and longitudinal movement components and the marine vessel 10 may only move in the longitudinal direction without violating the predetermined threshold distance between the marine vessel 10 and the external object 100, the modified movement selected by the control module 40 may control the first propulsion device 20 and the second propulsion device 30 such that only the longitudinal component of the requested movement is acted upon. Specifically, the steering angle $A_e$ and thrust $M_e$ of the first propulsion device 20 and the steering angle $A_t$ and thrust $M_t$ of the second propulsion device 30 can be modified to partially accomplish the requested movement without moving the marine vessel 10 in the direction of the external object 100. As shown in step 330, the control module 40 subsequently controls the steering and the thrust of both the first propulsion device 20 and the second propulsion device 30 according to the selection of either the requested movement or the modified movement selected in step 320.

Note that other desired directions input to the control module 40, such as by way of the joystick 60 or from the station keeping section of the marine propulsion system 11, will be acted upon so long as they do not bring the marine vessel 10 within the predetermined threshold of the external object 100. In other words, in response to the marine vessel 10 being within the predetermined threshold of the external object 100, the method further comprises generating any thrust components that do not cause movement in the direction of the external object 100. The typical determination for controlling the steering and thrust of the first propulsion device 20 and the second propulsion device 30 without using sensors 13, 15, 17, and 19, or when the marine vessel 10 is not approaching the predetermined threshold distance relative to the external object 100, can be modified by the control module 40 to create a modified movement.

FIGS. 6-12 show the integrated control of the steering and thrust of both the first propulsion device 20 and the second propulsion device 30 to achieve various requests for movement of the marine vessel 10. In each case, it is assumed that there is no information from a distance and directional sensor that would prevent free movement of the marine vessel 10. In each figure, the first propulsion device 20 and the second propulsion device 30 are each located along the longitudinal axis y, the first propulsion device 20 is located a longitudinal distance (A) from the center of pressure CP, and the second propulsion device 30 is located a longitudinal distance (B) from the center of pressure CP. However, the present methods and systems may also be applied to marine vessels having multiple propulsion devices at the stern 14, provided there is at least one propulsion device at or near the bow 12.

Both the magnitude and direction of the thrust, $M_e$ and the steering angle $A_e$, are determined by the control module 40 as described above. Based on the relationship between the thrust $M_e$ and the steering angle $A_e$, the thrust $M_e$ may be broken into its lateral component $S_e$ and its longitudinal component $F_e$ or $R_e$ to determine the respective forces exerted by the first propulsion device 20 on the marine vessel 10 in the lateral and longitudinal directions. Furthermore, the rotational force on the marine vessel 10 caused by the first propulsion device 20 can be determined by multiplying the lateral component $S_e$ with the moment arm between the steering axis 24 of the first propulsion device 20 and the center of pressure CP, which is shown as longitudinal distance (A).

Similarly, the second propulsion device 30 is shown to generate a thrust $M_t$ creating a force on the marine vessel 10. The thrust $M_t$ is generated at the steering angle $A_t$ from the longitudinal axis y. Based on this steering angle $A_t$, the respective lateral component $S_t$ and longitudinal component $F_t$ or $R_t$ can be determined Likewise, the lateral component $S_t$ can be used to determine the rotational force on the marine vessel 10 by multiplying the lateral component $S_t$ with the longitudinal distance (B) between the steering axis 34 of the second propulsion device 30 and the center of pressure CP. In other examples, the distances (A) and (B) can be measured between the CP and the actual points where thrust is produced, although when compared to the length of the vessel 10, the differences between the actual points where thrust is produced and the locations of the steering axes 24, 34 are negligible.

Figure 6:
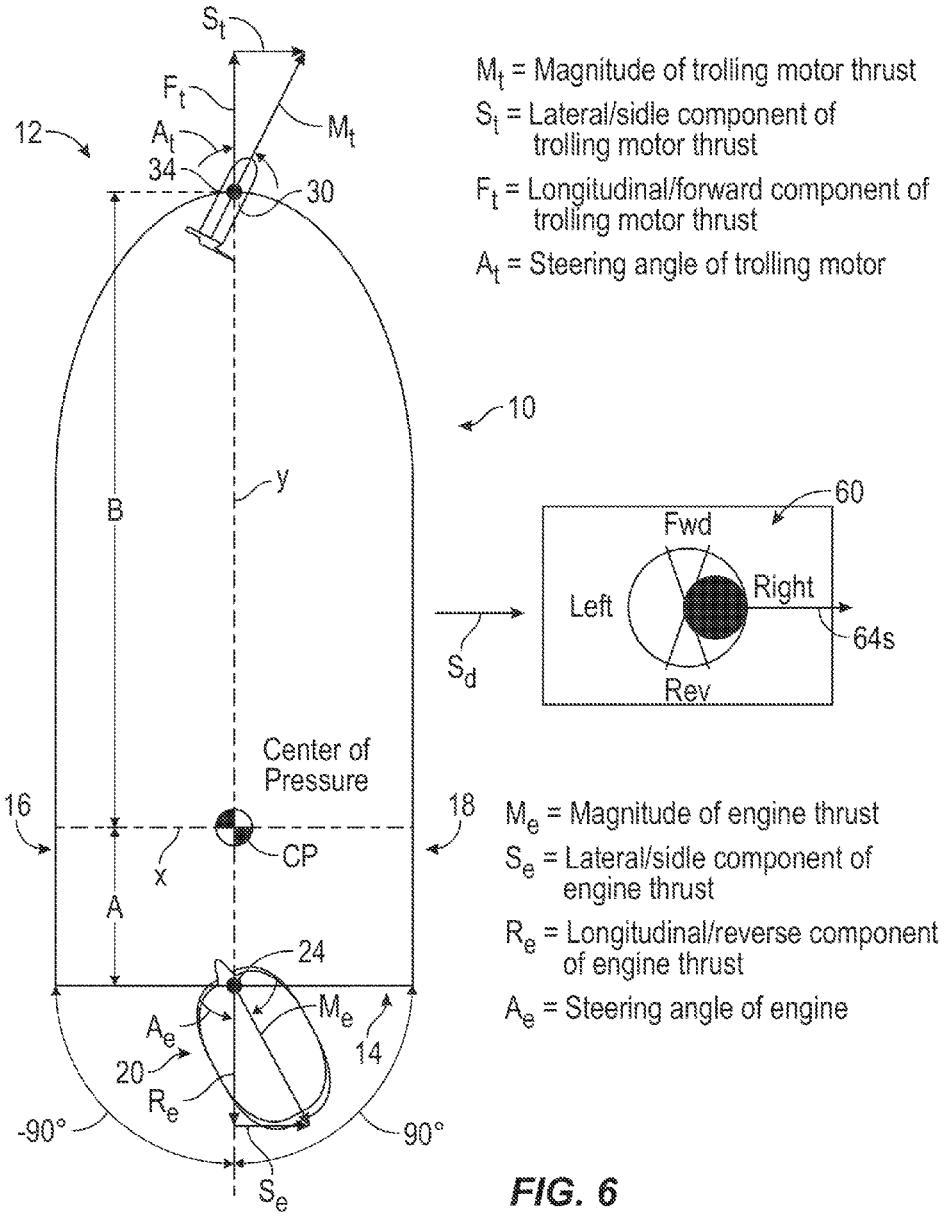
FIGS. 6 and 7 illustrate integrated steering and thrust control to achieve lateral movement of the marine vessel.
Figure 7:
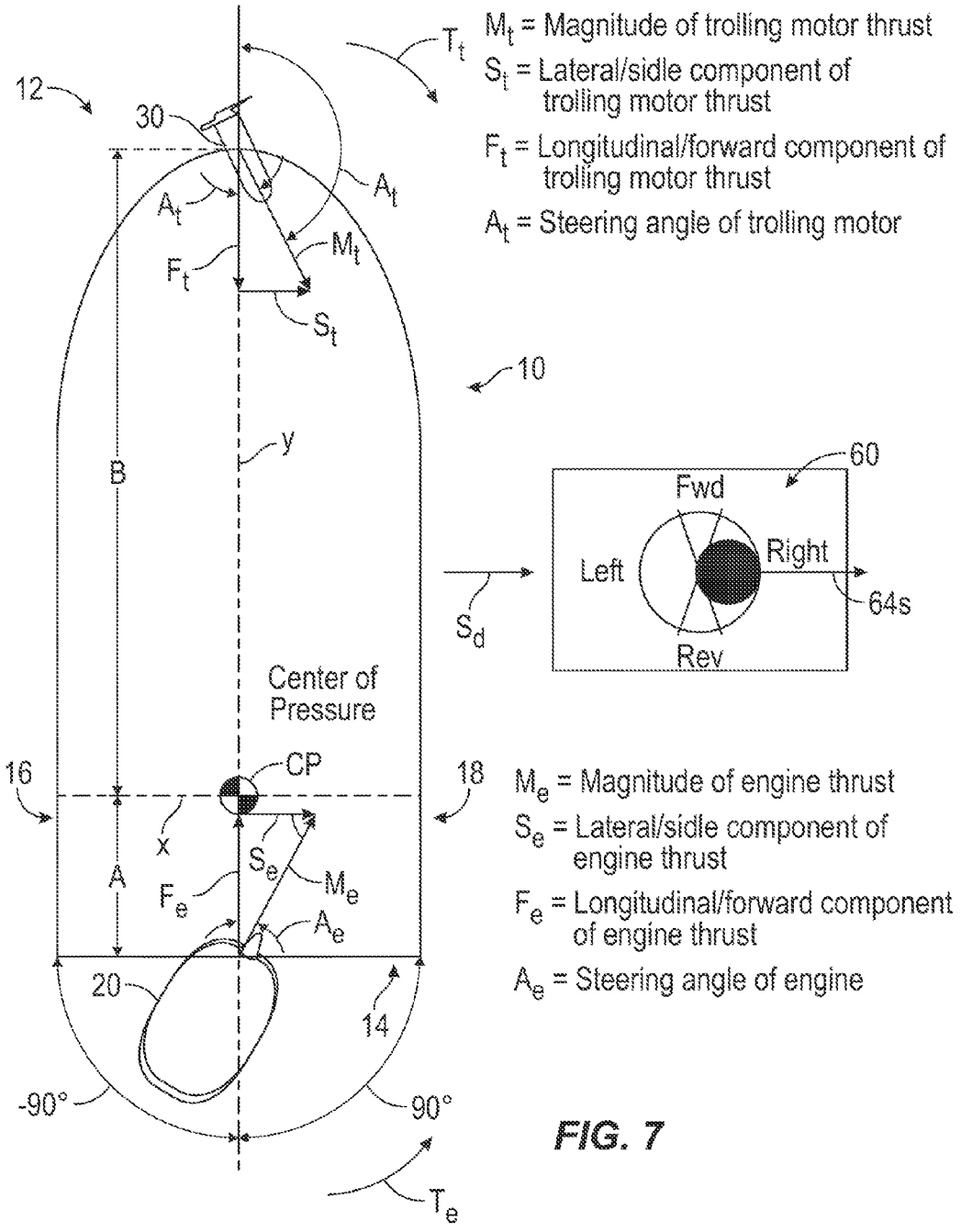

The control configurations shown in FIGS. 6 and 7 depict a joystick 60 in a position corresponding to a request for movement (translation) of the marine vessel 10 in a purely lateral direction towards the starboard side 18. Specifically, the handle 61 of joystick 60 is shown moved in a direction indicated by the arrow designated as 64*s*, which was previously discussed with respect to FIG. 4. The request does not include any longitudinal movement or rotational movement of the marine vessel 10. Thus, the integrated control from control module 40 would cause the first propulsion device 20 and the second propulsion device 30 to output or produce opposingly matched (i.e., of the same magnitude, but opposite directions) longitudinal thrust components $R_e$ and $F_t$, respectively, that are parallel to the longitudinal axis y, and lateral thrust components $S_e$ and $S_t$ that are parallel to the lateral axis x and unmatched (i.e., of different magnitudes). Thus, a first moment caused by the lateral thrust component $S_e$ acting at the longitudinal distance (A) from the center of pressure CP and a second moment caused by the lateral thrust component $S_t$ acting at the longitudinal distance (B) from the center of pressure balance each other to prevent rotational or yaw movement of the marine vessel 10.

In the control configuration shown in FIG. 6, the thrust $M_e$ of the first propulsion device 20 generates a force on the marine vessel 10 in the reverse direction towards the stern 14 and towards the starboard side 18. The thrust $M_e$ acts at a steering angle $A_e$ from the longitudinal axis y. Likewise, the second propulsion device 30 generates a force on the marine vessel 10 in the forward direction towards the bow 12 and towards the starboard side 18.

In one embodiment, as depicted in FIG. 6, the control module 40 receives the request from the input device and processes and controls the first propulsion device 20 and the second propulsion device 30 according to the following sequence of determinations.

Sequence 1:

The magnitude and direction of thrust $M_e$ and the steering angle $A_e$ for the first propulsion device 20 to produce the $S_e$ portion of the desired translation thrust $S_d$ can be determined from a lookup table or similar input/output map correlating a signal from the joystick 60 to calibrated values. The reverse thrust ($R_e$) (lbf) of the first propulsion device 20 may be provided in a lookup table based on propeller versus engine speed data stored in the memory 46. The value of $R_e$ can then be used to calculate the thrust $M_t$ and the steering angle $A_t$ of the second propulsion device 30 according to the following equations:

Total lateral thrust acting on vessel 10:

$$S_d\text{lbf}=S_e\text{lbf}+S_t\text{lbf} \quad \text{(Eq. 0)}$$

Longitudinal thrust component $R_e$ or $F_e$ for first propulsion device 20:

$$R_e\text{lbf}=M_e\text{lbf}\times\cos(A_e) \quad \text{(Eq. 1)}$$

Lateral thrust component for first propulsion device 20:

$$S_e\text{lbf}=M_e\text{ibf}\times\sin(A_e) \quad \text{(Eq. 2)}$$

Rotational or yaw component (moment) from first propulsion device 20:

$$T_e\text{lbf}\cdot\text{ft}=-S_e\text{lbf}\times A\ \text{ft} \quad \text{(Eq. 3)}$$

Longitudinal thrust component for second propulsion device 30:

$$F_t\text{lbf}=M_t\text{lbf}\times\cos(A_t) \quad \text{(Eq. 4)}$$

Lateral thrust component for second propulsion device 30:

$$S_t\text{lbf}=M_t\text{lbf}\times\sin(A_t) \quad \text{(Eq. 5)}$$

Rotational or yaw component (moment) from second propulsion device 30:

$$T_t\text{lbf}\cdot\text{ft}=S_t\text{lbf}\times B\ \text{ft} \quad \text{(Eq. 6)}$$

Solving for the second propulsion device 30 to eliminate yaw because no yaw was requested:

$$0\ \text{lb}\cdot\text{ft}=(S_t\text{lbf}\times B\ \text{ft})-(S_e\text{lbf}\times A\ \text{ft}) \quad \text{(Eq. 7)}$$

Rearrange:

$$S_t\text{lbf}=S_e\text{lbf}\times(A/B) \quad \text{(Eq. 7.1)}$$

Longitudinal thrust components must be equal because no longitudinal translation was requested:

$$F_t=R_e \quad \text{(Eq. 8)}$$

Resulting calculated second propulsion device 30 thrust:

$$M_t\text{lbf}=\sqrt{((F_t\text{lbf})^2+(S_t\text{lbf})^2)} \quad \text{(Eq. 9)}$$

Second propulsion device 30 steering angle:

$$A_t=\arctan(S_t/F_t) \quad \text{(Eq. 10)}$$

Of course, in order to achieve the same marine vessel movement, the first propulsion device 20 need not be in reverse gear as shown in FIG. 6, but instead could be in forward gear, and the thrust of the second propulsion device 30 could be controlled correspondingly. In one embodiment, as depicted in FIG. 7, the control module 40 receives the request from the input device and processes and controls the first propulsion device 20 and the second propulsion device 30 according to the above sequence of determinations (Eqs. 1-9), only with the final equation replaced by the following equations:

Second propulsion device 30 steering angle when the first propulsion device 20 is in forward gear:

$$A_x=\arctan(S_t/F_t) \quad \text{(Eq. 10.1)}$$

Then, the steering angle used for control is:

$$A_t=180-A_x \quad \text{(Eq. 10.2)}$$

The present inventors have found the configuration shown in FIG. 6 to be particularly advantageous for generating lateral movement of the marine vessel 10. Specifically, while the control module 40 could cause a resultant movement of the marine vessel 10 in the same direction by controlling the first propulsion device 20 to cause a force on the marine vessel 10 in the forward direction (as is shown in FIG. 7) instead of in the reverse direction (as is shown in FIG. 6), operating the first propulsion device 20 in reverse is advantageous. In many marine propulsion devices, for example outboard motors, prop efficiency is such that the thrust generated in a reverse gear is less than the thrust generated in a forward gear at the same engine speed. Accordingly, where the first propulsion device 20 is capable of generating a greater magnitude of thrust $M_e$ than the second propulsion device 30 can generate for thrust $M_t$, such as with the use of an outboard motor and a trolling motor, respectively, the less powerful second propulsion device 30 is more capable of counteracting the forces of the first propulsion device 20 when the first propulsion device 20 is operated in reverse. In other words, operating the more powerful propulsion device in reverse reduces the difference in power between the propulsion devices.

As shown in FIG. 7, the first propulsion device 20 may also be controlled by the control module 40 to generate a thrust $M_e$ to force the marine vessel 10 in a forward direction towards the bow 12 and towards the starboard side 18. Likewise, the second propulsion device 30 is now controlled to generate a thrust $M_t$ in the reverse direction towards the stern 14 and towards the starboard side 18. In this regard, the control configurations shown in both FIG. 6 and FIG. 7 cause the same resultant movement of the marine vessel 10.

Figure 8:
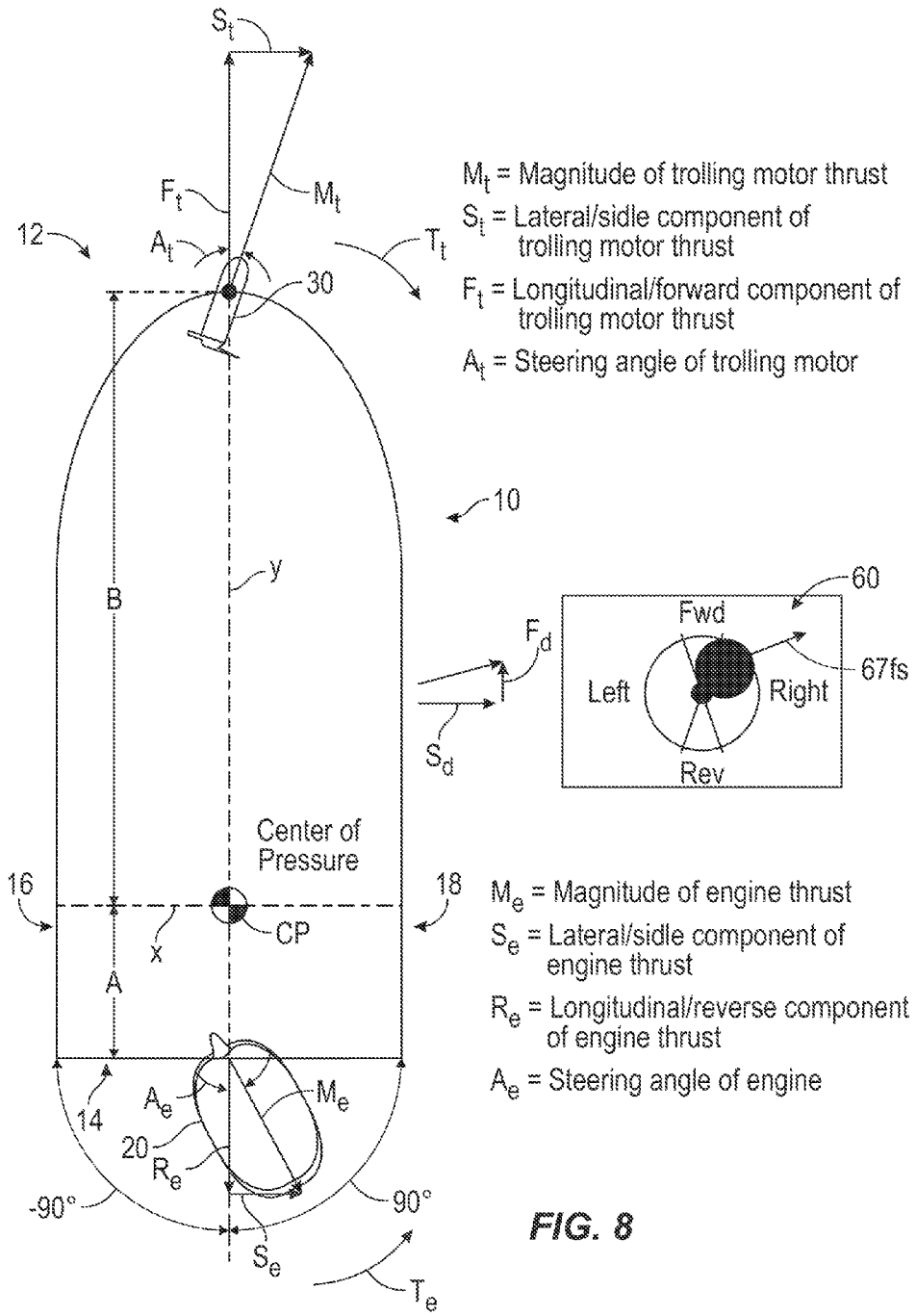
FIG. 8 illustrates integrated steering and thrust control to achieve lateral and longitudinal movement of the marine vessel.

FIG. 8 shows the joystick 60 position corresponding to a request for movement of the marine vessel 10 in a diagonal translation movement in a forward direction towards the bow 12 and towards the starboard side 18 indicated by the arrow designated 67*fs*, without yaw movement with respect to the longitudinal and lateral axes. In response, the integrated control from control module 40 would cause the first propulsion device 20 and the second propulsion device 30 to output unmatched longitudinal thrust components $R_e$ and $F_t$ that are parallel to the longitudinal axis y, and lateral thrust components $S_e$ and $S_t$ that are parallel to the lateral axis x and unmatched. Thus, a first moment caused by the lateral thrust component $S_e$ acting at the longitudinal distance (A) from the center of pressure CP and a second moment caused by the lateral thrust component $S_t$ acting at the longitudinal distance (B) from the center of pressure CP balance each other to prevent yaw movement of the marine vessel 10.

As compared to the control configuration of FIG. 6, the longitudinal component $F_t$ created by second propulsion device 30 is now greater than the longitudinal component $R_e$ generated by the first propulsion device 20 in the opposite, reverse direction. Accordingly, in addition to the lateral movement that was also generated in the configuration of FIG. 6, the configuration of FIG. 8 includes a longitudinal component, providing the resultant movement in accordance with the forward starboard 67*fs* direction as requested by the joystick 60.

In one embodiment, as depicted in FIG. 8, the control module 40 receives the request from the input device and processes and controls the first propulsion device 20 and the second propulsion device 30 according to the following sequence of determinations.

Using the previous determinations from sequence 1 provided above (Eqs. 1-6), new determinations for controlling the second propulsion device 30 are provided by the following sequence. The value $F_d$, the desired forward translation, may be determined from a lookup table or similar input/output map that correlates a position of the joystick handle to a desired resultant force in the forward direction.

Sequence 2:

Because no yaw was requested:

$$S_t\text{lbf}=S_e\text{lbf}\times(A/B) \quad \text{(Eq. 7.1)}$$

Solving for the second propulsion device 30:

$$F_t=R_e+F_d \quad \text{(Eq. 8.1)}$$

Resulting calculated second propulsion device 30 thrust:

$$M_t\text{lbf}=\sqrt{((F_t\text{lbf})^2+(S_t\text{lbf})^2)} \quad \text{(Eq. 9)}$$

Second propulsion device 30 steering angle:

$$A_t=\arctan(S_t/F_t) \quad \text{(Eq. 10)}$$

It should be noted that adjustments could be made to the control of the first propulsion device 20, or both the first propulsion device 20 and the second propulsion device 30, instead of those to the second propulsion device 30 above. For example, forward thrust of the first propulsion device 20 could be greater than reverse thrust of the second propulsion device 30.

Figure 9:
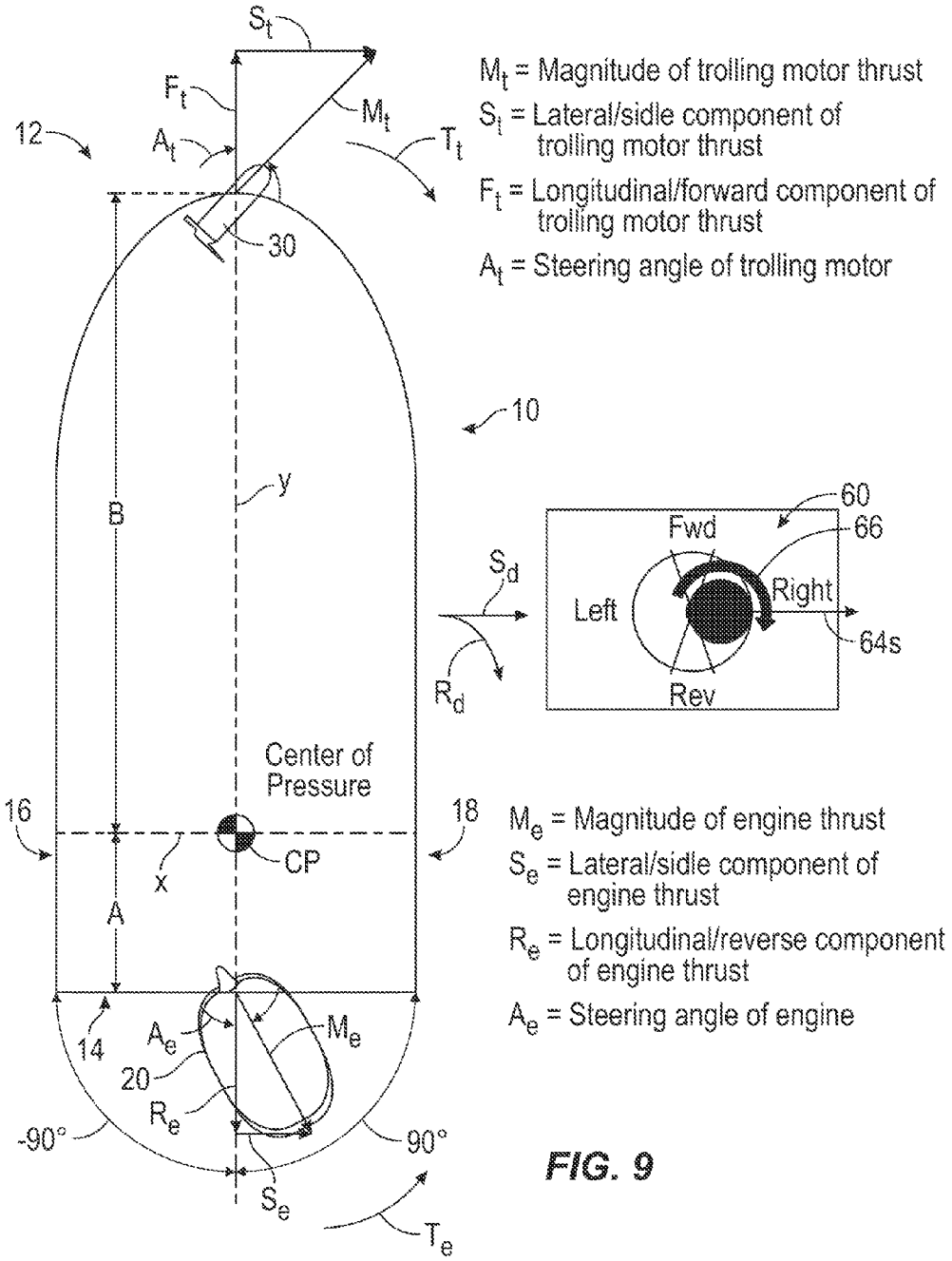
FIG. 9 illustrates integrated steering and thrust control to achieve lateral and rotational movement of the marine vessel.

FIG. 9 depicts the joystick 60 in an orientation corresponding with a request for movement of the marine vessel 10 in a lateral direction towards the starboard side 18, in addition to a rotational movement in the clockwise direction, as indicated by the arrows 64*s* and 66, respectively. The control module 40 controls the first propulsion device 20 and the second propulsion device 30 in a manner similar to the request shown in FIG. 6, but now adjusts the resultant forces such that the moments generated about the center of pressure CP are no longer balanced, providing the requested rotational movement.

Specifically, the integrated control from control module 40 causes the first propulsion device 20 and the second propulsion device 30 to output opposingly matching (i.e., of equal magnitude but opposite direction) longitudinal thrust components $R_e$ and $F_t$ that are parallel to the longitudinal axis y, and lateral thrust components $S_e$ and $S_t$ that are parallel to the lateral axis x and unmatched (i.e., of different magnitudes), but in the same direction. Thus, a first moment caused by the lateral thrust component $S_e$ acting at the longitudinal distance (A) from the center of pressure CP and a second moment caused by the lateral thrust component $S_t$ acting at the longitudinal distance (B) from the center of pressure CP are unbalanced to thereby cause yaw movement of the marine vessel 10. While the lateral thrust components $S_e$ and $S_t$ are shown to be in the same direction, these may also be in opposing directions.

It should be noted that while FIG. 9 generally depicts adding the rotational movement relative to that shown in FIG. 6 by principally adjusting the steering and thrust of the second propulsion device 30, the control module 40 can accomplish the same by adjusting the steering and thrust of the first propulsion device 20, or by adjusting the steering and thrust of a combination of both.

In one embodiment, as depicted in FIG. 9, the control module 40 receives and processes the request from the input device and controls the first propulsion device 20 and the second propulsion device 30 according to the following sequence of determinations.

Using the previous second propulsion device 30 determinations from sequence 1 provided above (Eqs. 1-6), the new determinations for controlling the second propulsion device 30 are provided by the following sequence. The value $S_d$ may be determined from a lookup table or similar input/output map that correlates a position of the joystick handle to a desired resultant force in the starboard direction. The value $T_d$, desired rotational movement, may be determined from a lookup table or similar input/output map that correlates a rotation of the joystick handle to a desired resultant yawing force in the clockwise direction.

Sequence 3:

Solving for the second propulsion device 30:

Because a resultant moment has been requested:

$$R_d\text{lbf·ft}=(S_t\text{lbf}\times B\text{ ft})-(S_e\text{lbf}\times A\text{ ft}) \quad \text{(Eq. 7.2)}$$

Rearrange:

$$S_t\text{lbf}=(S_e\text{lbf}\times(A/B))+(R_d\text{lbf·ft}/B\text{ ft}) \quad \text{(Eq. 7.3)}$$

Longitudinal thrust components must be equal because no longitudinal translation was requested:

$$F_t=R_e \quad \text{(Eq. 8)}$$

Resulting calculated second propulsion device 30 thrust:

$$M_t\text{lbf}=\sqrt{((F_t\text{lbf})^2+(S_t\text{lbf})^2)} \quad \text{(Eq. 9)}$$

Second propulsion device 30 steering angle:

$$A_t=\arctan(S_t/F_t) \quad \text{(Eq. 10)}$$

It should be noted that adjustments to the control of the first propulsion device 20, or both the first propulsion device 20 and the second propulsion device 30, could be made instead of these to the second propulsion device 30 as described above.

Figure 10:
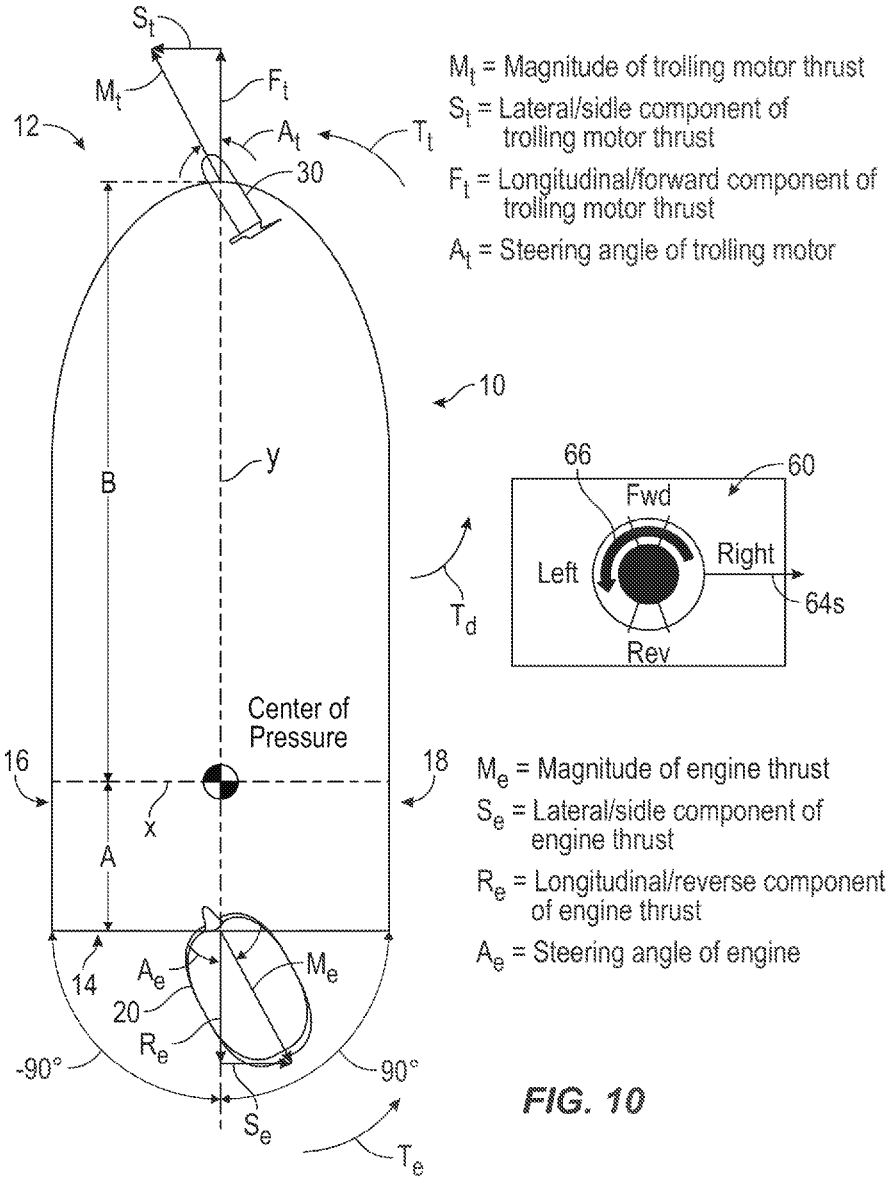
FIGS. 10 and 11 illustrate integrated steering and thrust control to achieve rotational movement of the marine vessel.

FIG. 10 depicts the joystick 60 being used to request movement of the marine vessel 10 in a purely rotational direction in accordance with the arrow designated 66. In the embodiment shown, the integrated control from control module 40 would cause the first propulsion device 20 and the second propulsion device 30 to output longitudinal components $R_e$ and $F_t$ that are parallel to the longitudinal axis y and opposingly matched (i.e., of equal magnitude, but in opposite directions), and lateral thrust components $S_e$ and $S_t$ that are parallel to the lateral axis x and opposingly matched (i.e., of equal magnitude, but in opposite directions). Thus, a first moment caused by the lateral thrust component $S_e$ acting at the longitudinal distance (A) from the center of pressure CP and a second moment caused by the lateral thrust component $S_t$ acting at the longitudinal distance (B) from the center of pressure CP are unbalanced (i.e., do not cancel one another) to thereby cause only yaw movement of the marine vessel 10.

In one embodiment, as depicted in FIG. 10, the control module 40 receives the request from the input device and processes and controls the first propulsion device 20 and the second propulsion device 30 according to the following sequence of determinations.

Using the previous second propulsion device 30 determinations from sequence 1 provided above, the new determinations for controlling the second propulsion device 30 are provided by the following sequence. The value $T_d$ may be determined from a lookup table or similar input/output map that correlates a rotation of the joystick to a desired rotational movement, such as a yaw movement in the clockwise direction.

Sequence 4:

Solving for the second propulsion device 30:

Because there is no resulting lateral movement, but there is yaw:

$$S_t\text{lbf}=S_e\text{lbf} \quad \text{(Eq. 7.4)}$$

Because there is no longitudinal movement:

$$F_t=R_e \quad \text{(Eq. 8)}$$

Resulting calculated second propulsion device 30 thrust:

$$M_t\text{lbf}=\sqrt{((F_t\text{lbf})^2+(S_t\text{lbf})^2)} \quad \text{(Eq. 9)}$$

Second propulsion device 30 steering angle:

$$A_t=\arctan(S_t/F_t) \quad \text{(Eq. 10)}$$

Figure 11:
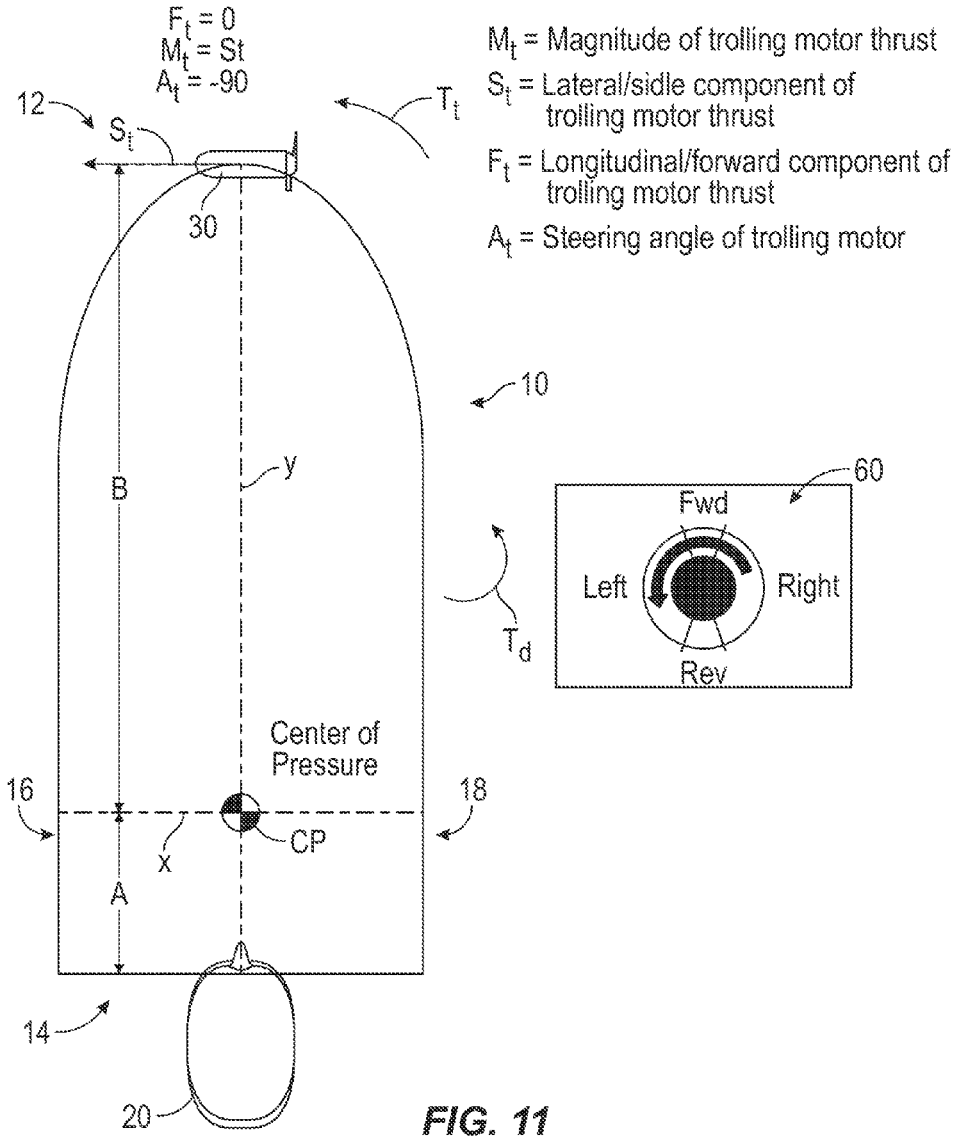

In the embodiment shown, the moments created by the first propulsion device 20 and the second propulsion device 30 are both in the counterclockwise direction, providing the requested rotational movement of the marine vessel 10. Alternatively, the control module 40 may cause a rotation of the marine vessel 10 in the same counterclockwise direction by controlling the steering and thrust of the first propulsion device 20 and the second propulsion device 30 such that thrust is only generated by one of the propulsion devices. Specifically, FIG. 11 shows the control module 40 controlling the steering and thrust of the second propulsion device 30 such that thrust is generated to force the bow 12 of the marine vessel 10 in a purely lateral direction whereby the magnitude of the thrust $M_t$ is entirely the lateral component $S_t$. Since the first propulsion device 20 does not generate any thrust, there is no longitudinal component, no lateral component, and no resulting moment caused about the center of pressure CP by the first propulsion device 20. Accordingly, the resultant movement of the marine vessel 10 is mostly rotational, with a negligible translation in the lateral direction based on the unopposed thrust created by the second propulsion device 30.

Figure 12:
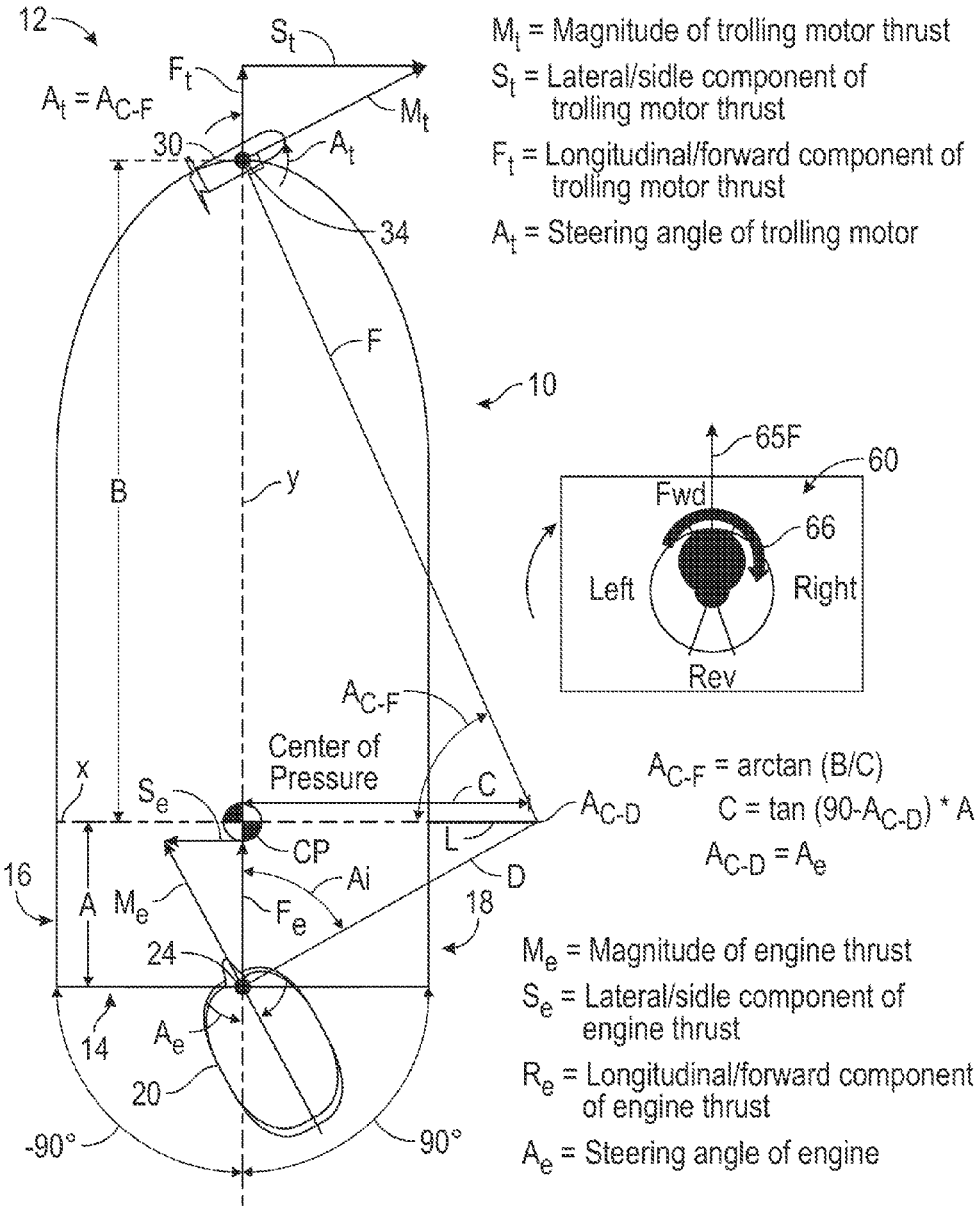
FIG. 12 illustrates integrated steering and thrust control to achieve longitudinal and rotational movement of the marine vessel.

In addition to the control module 40 providing integrated control of the first propulsion device 20 and the second propulsion device 30 to accomplish movements not traditionally possible by a marine vessel 10, such as purely lateral movement, rotational movement about the center of pressure CP, or combination thereof, the present systems and methods also provide for enhanced steering at slow speeds over presently known marine propulsion systems. FIG. 12 shows a control configuration whereby the joystick 60 has been moved in accordance with a request for movement of the marine vessel 10 in a forward direction as indicated by the arrow 65*f*, as well as a clockwise rotational movement as indicated by the arrow 66. As previously introduced, the integrated control of both the first propulsion device 20 and the second propulsion device 30 by the control module 40 permits more responsive steering of the marine vessel 10 while moving in the forward or reverse direction over what could be accomplished using the first propulsion device 20 alone. The present inventors have also found this enhanced steering to be particularly beneficial for longer marine vessels, which often have a large mass and a long moment arm to control while steering with a propulsion device positioned near the stern.

In the configuration shown in FIG. 12, the integrated control from control module 40 would cause the first propulsion device 20 and the second propulsion device 30 to output longitudinal thrust components $F_e$ and $F_t$ having the same orientation and being parallel to the longitudinal axis y, and lateral thrust components $S_e$ and $S_t$ having opposing orientations and being parallel to the lateral axis x. Thus, a first moment caused by the lateral thrust component $S_e$ acting at the longitudinal distance (A) from the center of pressure CP and a second moment caused by the lateral thrust component $S_t$ acting at the longitudinal distance (B) from the center of pressure CP have the same orientation and cause yaw movement of the marine vessel 10.

Through experimentation and testing, the present inventors have discovered that slow speed steering is optimized by the following configuration. The longitudinal components $F_e$ and $F_t$ have the same orientation in the forward direction, parallel to the longitudinal axis y. The lateral components $S_e$ and $S_t$ have opposing orientations such that each creates a moment about the center of pressure CP in the clockwise direction, thereby causing a rotational or yaw movement of the marine vessel 10. The steering and thrust of the second propulsion device 30 can be optimized based on the turning radius (C) that corresponds to the steering angle $A_e$ of the first propulsion device 20. The distance (C) is solved for by determining where a lateral line (L), which extends from the center of pressure CP parallel to the lateral axis x, intersects with a first steering line (D), which extends from the first steering axis 24 and is perpendicular to the steering angle $A_e$ of the first propulsion device 20. In other words, the turning radius is a distance (C) from the center of pressure CP to the intersection. The control module 40 then controls the steering and thrust of the second propulsion device 30 such that a second steering line (F) that extends from the second steering axis 34 and is perpendicular to the steering angle $A_t$ intersects with the lateral line (L) at the same point where the first steering line (D) intersects with the lateral line (L). While the inventors have found the previous configuration to be particularly advantageous, the control module 40 can control the movement of the bow 12 more aggressively by selecting a steering angle $A_t$ for the second propulsion device 30 that is larger than the optimized value previously provided.

In one embodiment, as depicted in FIG. 12, the control module 40 receives and processes the request from the input device and controls the first propulsion device 20 and the second propulsion device 30 according to the following sequence of determinations.

The value $F_d$ may be determined from a lookup table or similar input/output map that correlates a position of the joystick to a desired movement in the forward direction. The value $R_d$ may be determined from a lookup table or similar input/output map that correlates a rotation for the joystick to a desired rotational movement, such as a yaw movement in the clockwise direction. If the distance (A) from the first steering axis 24 to the center of pressure (CP) and the steering angle ($A_e$) are known, then the length of (C) can be determined by:

Sequence 5:

The angle between lines C and D at the point of intersection is the same as the steering angle $A_e$ of the first propulsion device 20 with respect to the longitudinal axis y.

$$A_{C\text{-}D}=A_e \quad \text{(Eq. 11)}$$

Angle between lines A and D at the first steering axis 24.

$$A_i=(90-A_{C\text{-}D}) \quad \text{(Eq. 12)}$$

Resulting calculated turning radius.

$$C=\tan(A_i)\times A \quad \text{(Eq. 13)}$$

The angle of the second propulsion device 30 from the longitudinal axis y (steering angle $A_t$) is the same as angle $A_{C\text{-}F}$ (the angle between lines C and F at the point of intersection).

$$A_{C\text{-}F}=\arctan(B/C) \quad \text{(Eq. 14)}$$

The angle of the second propulsion device 30 from the longitudinal axis y is the same as angle $A_{C\text{-}F}$.

$$A_t=A_{C\text{-}F} \quad \text{(Eq. 15)}$$

Calculating the thrust required at the second propulsion device 30 ($M_t$) to perform a coordinated turn with the first propulsion device 20 requires the turning radius of the second propulsion device 30 (F):

$$F\ \text{ft}=\sqrt{((B\ \text{ft})^2+(C\ \text{ft})^2)} \quad \text{(Eq. 16)}$$

The ratio of the thrust of the first propulsion device 20 ($M_e$) to its turning radius (D) should be equal to the ratio of the thrust of the second propulsion device 30 ($M_t$) to its turning radius (F).

$$(M_e\text{lbf})/(D\ \text{ft})=(M_t\text{lbf})/(F\ \text{ft}) \quad \text{(Eq. 17)}$$

Solving for the magnitude of thrust of the second propulsion device 30.

$$(M_t\text{lbf}=(F\ \text{ft}/D\ \text{ft})\times(M_e\text{lbf}) \quad \text{(Eq. 18)}$$

Thus, the thrust provided by the second propulsion device 30 is equal to the thrust provided by the first propulsion device 20 multiplied by the ratio of the distance (F) over the distance (D).

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein:

the marine vessel has a center of pressure located between the bow and the stern, wherein the first propulsion device is located a longitudinal distance (A) from the center of pressure, and wherein the second propulsion device is located a longitudinal distance (B) in an opposite direction from the center of pressure;

the request for movement of the marine vessel is a request for translation parallel to the lateral axis, without yaw movement with respect to the longitudinal and lateral axes; and the control module is configured to cause the first propulsion device and the second propulsion device to output:

opposingly matched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure balance each other to prevent yaw movement of the marine vessel.

2. The system according to claim 1, wherein the control module is configured to operate the first propulsion device in a reverse gear to achieve the resultant movement of the marine vessel.

3. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein:

the marine vessel has a center of pressure located between the bow and the stern, wherein the first propulsion device is located a longitudinal distance (A) from the center of pressure, and wherein the second propulsion device is located a longitudinal distance (B) in an opposite direction from the center of pressure;

the request for movement of the marine vessel is a request for translation at an angle to the longitudinal axis and at an angle to the lateral axis, without yaw movement with respect to the longitudinal and lateral axes, and the control module is configured to cause the first propulsion device and the second propulsion device to output:

unmatched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure balance each other to prevent yaw movement of the marine vessel.

4. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein:

the marine vessel has a center of pressure located between the bow and the stern, wherein the first propulsion device is located a longitudinal distance (A) from the center of pressure, and wherein the second propulsion device is located a longitudinal distance (B) in an opposite direction from the center of pressure;

the request for movement of the marine vessel is a request for translation parallel to the lateral axis, with yaw movement with respect to both the longitudinal axis and lateral axis; and the control module is configured to cause the first propulsion device and the second propulsion device to output:

opposingly matched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure are unbalanced to thereby cause yaw movement of the marine vessel.

5. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein the request for movement of the marine vessel is a request for rotation about the center of pressure, and wherein the control module is configured to cause the first propulsion device and the second propulsion device to output a first lateral thrust component and a second lateral thrust component, respectively, that are parallel to the lateral axis and opposingly matched, wherein a first moment caused by the first lateral thrust component acting at the longitudinal distance (A) from the center of pressure and a second moment caused by the second lateral thrust component acting at the longitudinal distance (B) from the center of pressure are unbalanced to thereby cause yaw movement of the marine vessel.

6. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein:

the marine vessel has a center of pressure located between the bow and the stern, wherein the first propulsion device is located a longitudinal distance (A) from the center of pressure, and wherein the second propulsion device is located a longitudinal distance (B) in an opposite direction from the center of pressure;

the request for movement of the marine vessel is a request for translation parallel to the longitudinal axis, with yaw movement with respect to both the longitudinal axis and the lateral axis; and the control module is configured to cause the first propulsion device and the second propulsion device to output:

longitudinal thrust components having the same orientation and being parallel to the longitudinal axis, and a first lateral thrust component and a second lateral thrust component, respectively, having opposing orientations and being parallel to the lateral axis, wherein a first moment caused by the first lateral thrust component acting at the longitudinal distance (A) from the center of pressure and a second moment caused by the second lateral thrust component acting at the longitudinal distance (B) from the center of pressure have the same orientation and cause yaw movement of the marine vessel.

7. The system according to claim 6, wherein the steering and the thrust of the second propulsion device is based on a turning radius corresponding to the steering angle of the first propulsion device, wherein a lateral line extends from the center of pressure and is parallel to the lateral axis, wherein a first steering line extends from the first steering axis and is perpendicular to the steering angle of the first propulsion device, wherein a second steering line extends from the second steering axis and is perpendicular to the steering angle of the second propulsion device, wherein the lateral line and the first steering line intersect at an intersection, wherein the turning radius is a distance (C) from the center of pressure to the intersection, and wherein the steering angle of the second propulsion device is chosen such that the second steering line intersects with the lateral line at the intersection.

8. The system according to claim 7, wherein the second steering line intersects with the lateral line at the intersection, wherein a distance (D) is defined between the first steering axis and the intersection, wherein a distance (F) is defined between the second steering axis and the intersection, and wherein the thrust provided by the second propulsion device is equal to the thrust provided by the first propulsion device multiplied by the ratio of the distance (F) over the distance (D).

9. A system for controlling movement of a marine vessel that extends along a longitudinal axis between a bow and a stern and along a lateral axis between a port side and a starboard side, wherein the longitudinal axis is perpendicular to the lateral axis, and wherein the marine vessel has a center of pressure located between the bow and the stern, the system comprising:

a first propulsion device located closer to the stern than to the bow and at a longitudinal distance (A) from the center of pressure, wherein the first propulsion device is steerable about a first steering axis that is perpendicular to the longitudinal axis and perpendicular to the lateral axis;

a second propulsion device located closer to the bow than to the stern and at a longitudinal distance (B) in an opposite direction from the center of pressure as the longitudinal distance (A), wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel;

wherein the request for movement of the marine vessel is one of movement of the marine vessel:

parallel to the longitudinal axis;

parallel to the lateral axis, without yaw movement with respect to the longitudinal and lateral axes;

in translation at an angle to the longitudinal axis and at an angle to the lateral axis;

parallel to the lateral axis, with yaw movement with respect to both the longitudinal and lateral axes;

in rotation about the center of pressure; or parallel to the longitudinal axis, with yaw movement with respect to both the longitudinal and lateral axes.

10. The system according to claim 9, wherein the second propulsion device is a trolling motor, and wherein the second propulsion device is steerable at least 10 degrees about the second steering axis.

11. The system according to claim 9, wherein the input device is a manually operable joystick.

12. The system according to claim 9, wherein the control module is configured to detect a distance between the marine vessel and an external object, and wherein the control module is configured to cause the first propulsion device and the second propulsion device to stop producing thrust when the distance between the marine vessel and the external object is less than a predetermined threshold.

13. The system according to claim 9, wherein the control module is configured to cause the first propulsion device and the second propulsion device to output:

thrust components that are parallel to the longitudinal axis if the request for movement of the marine vessel is a request for movement of the marine vessel parallel to the longitudinal axis;

opposingly matched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure balance each other to prevent yaw movement of the marine vessel, if the request for movement of the marine vessel is a request for movement parallel to the lateral axis, without yaw movement with respect to the longitudinal and lateral axes;

unmatched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure balance each other to prevent yaw movement of the marine vessel, if the request for movement of the marine vessel is a request for translation at an angle to the longitudinal axis and at an angle to the lateral axis;

opposingly matched longitudinal thrust components that are parallel to the longitudinal axis, and a first lateral thrust component and a second lateral thrust component, respectively, that are parallel to the lateral axis and unmatched, wherein a first moment caused by the first lateral thrust component acting at the longitudinal distance (A) from the center of pressure and a second moment caused by the second lateral thrust component acting at the longitudinal distance (B) from the center of pressure are unbalanced to thereby cause yaw movement of the marine vessel, if the request for movement of the marine vessel is a request for movement parallel to the lateral axis, with yaw movement with respect to both the longitudinal and lateral axes;

a first lateral thrust component and a second lateral thrust component, respectively, that are parallel to the lateral axis and opposingly matched, wherein a first moment caused by the first lateral thrust component acting at the longitudinal distance (A) from the center of pressure and a second moment caused by the second lateral thrust component acting at the longitudinal distance (B) from the center of pressure are unbalanced to thereby cause yaw movement of the marine vessel, if the request for movement of the marine vessel is a request for rotation about the center of pressure; and longitudinal thrust components having the same orientation and being parallel to the longitudinal axis, and a first lateral thrust component and a second lateral thrust component, respectively, having opposing orientations and being parallel to the lateral axis, wherein a first moment caused by the first lateral thrust component acting at the longitudinal distance (A) from the center of pressure and a second moment caused by the second lateral thrust component acting at the longitudinal distance (B) from the center of pressure have the same orientation and cause yaw movement of the marine vessel, if the request for movement of the marine vessel is a request for movement parallel to the longitudinal axis, with yaw movement with respect to both the longitudinal and lateral axes.

14. A system for controlling movement of a marine vessel that extends along a longitudinal axis between a bow and a stern and along a lateral axis between a port side and a starboard side, wherein the longitudinal axis is perpendicular to the lateral axis, the system comprising:

a first propulsion device located closer to the stern than to the bow, wherein the first propulsion device is steerable about a first steering axis that is perpendicular to the longitudinal axis and perpendicular to the lateral axis;

a second propulsion device located closer to the bow than to the stern, wherein the second propulsion device is steerable about a second steering axis that is perpendicular to the longitudinal axis and perpendicular to the lateral axis;

a control module configured to control steering of and thrust provided by both the first propulsion device and the second propulsion device, wherein a steering angle is defined as the angle that the thrust is provided relative to the longitudinal axis; and an input device configured to input a request for movement of the marine vessel to the control module;

wherein based upon the request for movement, the control module is configured to control steering of and thrust provided by both the first propulsion device and the second propulsion device to thereby achieve a resultant movement of the marine vessel that is commensurate with the request for movement of the marine vessel, wherein the input device includes a translation switch and a steering wheel that turns between a left stop and a right stop, wherein the control module is configured to cause the first propulsion device and the second propulsion device to both output thrust components that are parallel to the longitudinal axis when the translation switch is actuated and the steering wheel is steered to one of the left stop or the right stop.

15. A method for controlling movement of a marine vessel that extends along a longitudinal axis between a bow and a stern and along a lateral axis between a port side and a starboard side, wherein the longitudinal axis is perpendicular to the lateral axis, the method comprising:

providing a first propulsion device located closer to the stern than to the bow, wherein the first propulsion device is steerable about a first steering axis that is perpendicular to the longitudinal axis and perpendicular to the lateral axis;

providing a second propulsion device located closer to the bow than to the stern, wherein the second propulsion device is steerable about a second steering axis that is perpendicular to the longitudinal axis and perpendicular to the lateral axis;

inputting, with an input device, a request for movement of the marine vessel to control module; and controlling, with the control module, steering of and thrust provided by both the first propulsion device and the second propulsion device to thereby achieve a resultant movement of the marine vessel that is commensurate with the request for movement of the marine vessel;

wherein the marine vessel has a center of pressure located between the bow and the stern, wherein the first propulsion device is located a longitudinal distance (A) from the center of pressure, and wherein the second propulsion device is located a longitudinal distance (B) in an opposite direction from the center of pressure, and wherein the request for movement includes a request for rotation about the center of pressure.

* * * * *